United States Patent [19]

Pollman

[11] 4,352,367

[45] Oct. 5, 1982

[54] ELECTRO-HYDRAULIC CONTROL STRUCTURE

[75] Inventor: Frederic W. Pollman, Ames, Iowa

[73] Assignee: Sundstrand Corporation, Rockford, Ill.

[21] Appl. No.: 170,084

[22] Filed: Jul. 18, 1980

[51] Int. Cl.[3] ..... F16K 31/04

[52] U.S. Cl. ..... 137/82; 137/316; 137/625.5; 137/625.61; 137/625.62; 251/129

[58] Field of Search ..... 137/82, 316, 625.5, 137/625.62, 625.61; 251/129

[56] References Cited

U.S. PATENT DOCUMENTS

| | | | |
|---|---|---|---|
| 2,767,689 | 10/1956 | Moog | 121/46.5 |
| 2,844,158 | 7/1958 | Carson | 137/82 |
| 2,924,241 | 2/1960 | Bauer | 137/623 |
| 3,023,782 | 3/1962 | Chaves, Jr. et al. | 137/623 |
| 3,055,631 | 9/1962 | Kippenhan | 251/129 |
| 3,203,447 | 8/1965 | Bremner et al. | 137/595 |
| 3,228,423 | 1/1966 | Moog | 137/625.62 |
| 3,339,572 | 9/1967 | Gordon et al. | 137/85 |
| 3,740,594 | 6/1973 | Casey | 310/30 |

FOREIGN PATENT DOCUMENTS

| | | | |
|---|---|---|---|
| 2262925 | 6/1974 | Fed. Rep. of Germany | 251/129 |

OTHER PUBLICATIONS

Pp. 4 and 5 of Literature Relating to Moog Controller. Two Sheets of Drawings Relating to Moog 62-500 Assembly.

*Primary Examiner*—Gerald A. Michalsky
*Attorney, Agent, or Firm*—Wegner, McCord, Wood & Dalton

[57] ABSTRACT

A motor-nozzle coupling member for coupling a motor to a nozzle in an electro-hydraulic control structure wherein a linear electric motor having an armature is located at a fixed distance relative to the nozzle by a coupler which engages the motor and nozzle and extends therebetween to establish the spacing between the motor and nozzle and with the coupler being deformable after initial assembly to set the desired spacing.

14 Claims, 4 Drawing Figures

ELECTRO-HYDRAULIC CONTROL STRUCTURE

BACKGROUND OF THE INVENTION

This invention pertains to coupling means for a motor and a nozzle in an electro-hydraulic control structure which enables accurate adjustment of the spacing between the motor and nozzle after the components are assembled. The structure is not subject to incorrect assembly, movement when in service due to wear or vibration and not easily tampered with by persons attempting repair in the field.

There are many pressure-responsive devices that respond to a pilot pressure and more particularly to a differential pilot pressure. Such differential pilot pressure can be applied directly to an operating system, such as the displacement control for a pump as shown in Hann et al U.S. Pat. No. 3,359,727. The differential pilot pressure can also be used as the first stage of a two-stage control, with the second stage being, as an example, a displacement control valve, such as shown in the Crull U.S. Pat. No. 3,946,560.

Electro-hydraulic control structures are known wherein the differential pilot pressure is obtained by controlling the flow through a pair of nozzles associated with a pair of pilot lines and with the control of flow through the nozzles being by means of a member positionable by an electric motor. Typical control structures of this type are shown in U.S. Pat. Nos. 2,625,136; 2,924,241; and 3,023,782. In such structures, a pressure differential between the two pilot lines is determined by positioning of the member relative to nozzles through which fluid flows. The location and spacing of the nozzles relative to such member when in a centered position is critical as this affects the pilot pressure obtained at any operative position of the member. As illustrated in the Bauer U.S. Pat. No. 2,924,241, there are a pair of opposed nozzles with a movable member operable by a motor associated therebetween and the nozzles are rotatably mounted within a housing for adjustment. Such adjustment is time-consuming and difficult to maintain over an extended period of use. Additionally, the proper setting of the structure can be easily tampered with by unknowledgeable field repair persons.

It is also known to mount the nozzles to the motor by means of a press fit, with such mounting being tamper-resistant, but being difficult to initially adjust because of the uncertain friction characteristics of press-fit relation between the parts with the added requirement for more precision in the manufacture of the parts.

A linear electrical motor of the type utilized in the invention disclosed herein is shown in Casey U.S. Pat. No. 3,740,594.

SUMMARY OF THE INVENTION

A primary feature of the invention disclosed herein is to provide coupling means for a motor and nozzle in an electro-hydraulic control structure which utilizes a relatively simple, easily manufactured coupler which can be deformed during adjustment after assembly to establish a desired distance between the motor and nozzle and which thereafter cannot be easily tampered with to change the adjustment. Additionally, the coupler is not susceptible to incorrect assembly or to movement when in service due to wear or vibration.

In carrying out the foregoing, a coupler is positioned between a motor and a nozzle, with the coupler being shaped and of a material enabling deformation after assembly to set the desired spacing between the motor and nozzle.

In the use of a double-ended motor having an armature extendable from both ends thereof, there are a pair of nozzles adjacent each end of the motor and each having a nozzle port opening toward the armature. A pair of couplers are associated with the motor and one with each of the nozzles whereby, after assembly of the components, force can be exerted against one coupler to cause the necessary deformation in the other coupler to set the distance between the nozzle associated with the last-mentioned coupler and, thereafter, force can be exerted against the previously deformed coupler to deform the first-mentioned coupler and set the desired distance between the motor and the nozzle associated with the first-mentioned coupler.

The assembly of the motor with one or more nozzles is accomplished by insertion of a tool into a chamber within a housing mounting the motor. The chamber is closed during use of the control structure which avoids exposure of any adjustment structure for unwanted adjustment.

The use of deformable coupling members directly interconnecting the motor and nozzles to maintain a fixed distance therebetween makes the structure insensitive to movement relative to a housing in which the components are mounted, such as might happen with shock, vibration or differential thermal expansion. Additionally, no locking device is required to maintain the set adjustment with resulting reduction in parts and increased reliability.

An object of the invention is to provide an electro-hydraulic control structure having a housing with a chamber and a pair of aligned bores at opposite sides of the chamber, a pair of nozzles movably mounted in said bores with each nozzle having a port opening towards said chamber, a linear electric motor movably positioned in said chamber and having an armature extendable from opposite ends of the motor and operable to a position to control the rate of fluid flow through the nozzle ports, and a pair of couplers extending from opposite ends of the motor and engageable one with each of said nozzles to maintain a fixed distance between said motor and said nozzle and with the couplers being deformable after assembly to set the aforesaid fixed distances.

DESCRIPTION OF THE PREFERRED EMBODIMENT

Figures 2, 3, 4:
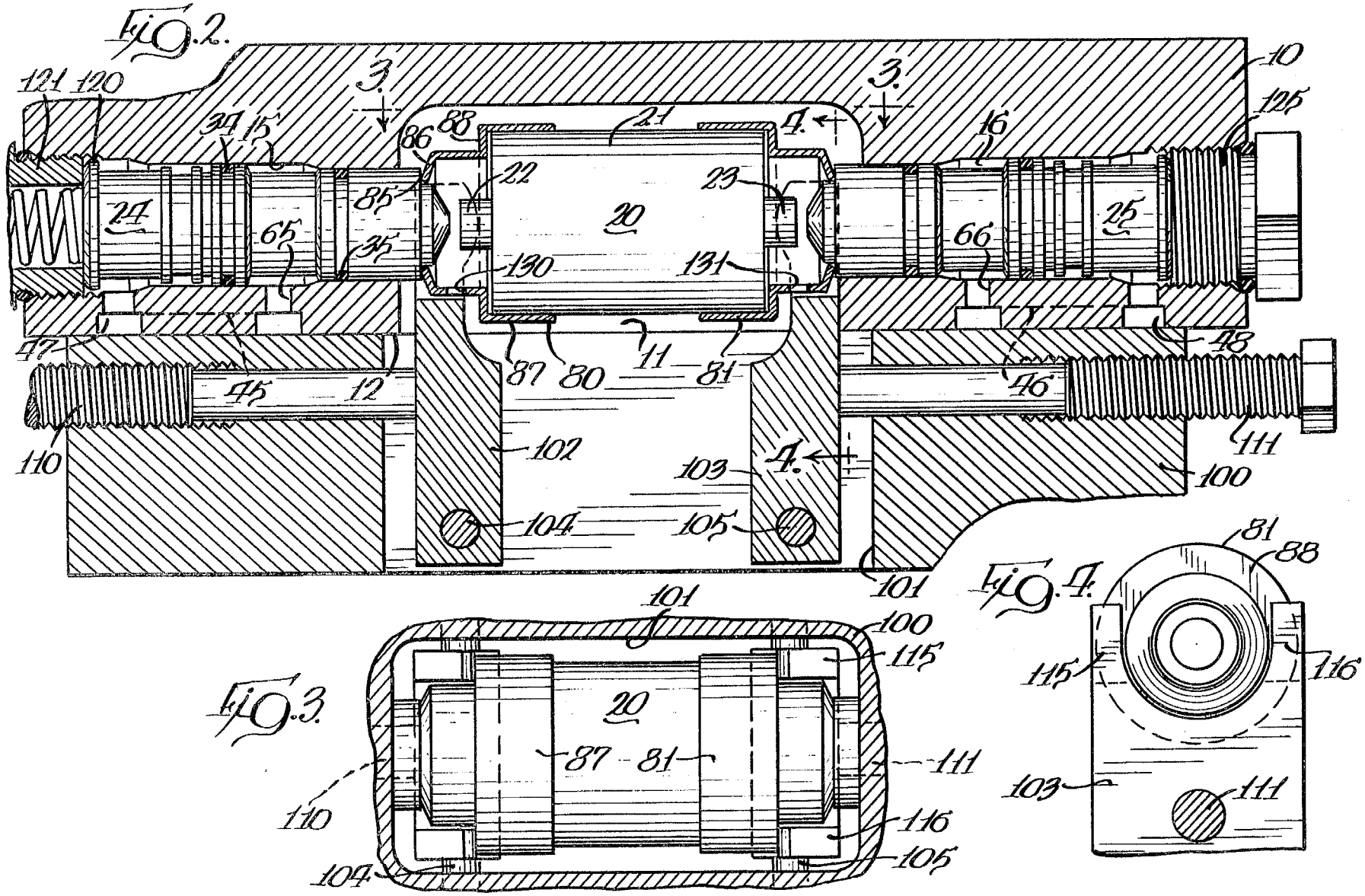
FIG. 2 is a vertical section, taken generally along the line 2—2 in FIG. 1, and showing an adjustment tool in association with the couplers prior to final adjustment thereof.
FIG. 3 is a section, taken generally along the line 3—3 in FIG. 2.
FIG. 4 is a fragmentary, vertical section, taken generally along the line 4—4 in FIG. 2.

The electro-hydraulic control structure has a housing 10 with a chamber 11 which opens to a bottom side 12 of the housing. The housing bottom side 12 mounts against another housing (not shown) which has various fluid connections to the housing 10. The part against which the bottom side 12 is shown in abutting relation in FIG. 2 is an adjusting tool used during assembly and adjustment and not part of the operative structure and will be described subsequently.

A pair of bores 15 and 16 are formed in the housing 10 in aligned relation at opposite sides of the chamber 11 and both open into the chamber 11. A linear motor 20, which may generally be of the type shown in Casey U.S. Pat. No. 3,740,594, is positioned within the chamber 11 and has a casing 21 from which opposite ends of a movable member, in the form of an armature extend, and which are identified at 22 and 23. Each of the bores 15 and 16 mounts a nozzle 24 and 25, respectively, and each has an end extending into the chamber 11 with a nozzle port 26 and 27, respectively, which coact with the ends 22 and 23 of the armature. The position of an armature end relative to an adjacent nozzle port controls the rate of fluid flow from within a nozzle through the nozzle port to the chamber 11 and then to drain.

Each of the nozzles 24 and 25 is of similar construction. The nozzle 24 has an internal bore 30 which receives fluid from a pressure source delivered to the housing bore 15 through an orifice 31 formed in the annular wall of the nozzle. A pilot pressure established within the internal bore of the nozzle communicates with passages to be described through a pilot port 32. The nozzle has a filter 33 mounted therein and has external lands, certain of which capture O-rings 34 and 35 to seal the nozzle within the housing bore 15 while permitting relative movement therebetween. A pair of reduced diameter external lands 36 and 37 permit inlet fluid to reach the orifice 31. Similarly, the nozzle 25 has a bore 38 communicating with inlet pressure through an orifice 39 and has a pilot port 40 as well as the filter and land structure described in connection with the nozzle 24.

The housing bores 15 and 16 are supplied with fluid from a pressure source by a pair of fluid inlet passages 45 and 46 formed as recesses in the bottom side 12 of the housing 10 and which terminate in ports 47 and 48, respectively, which open to the outer ends of the housing bores 15 and 16. The inlet passage recesses are closed when the bottom side 12 of the housing is mounted to the other housing previously referred to. The pair of fluid pressure inlet passages 45 and 46 have a common inlet 49 communicating with a bore 50 in the housing which mounts a conventional pressure-regulating valve, indicated generally at 51. Pressure fluid enters the housing 10 through an inlet 52 communicating with a passage 53 which communicates with the housing bore 50. A valve spool 54 within the housing bore 50 is urged toward the left, as viewed in FIG. 1, by a spring 55 to cause a land 56 of the valve to be variably positioned relative to the passage 53 opening into the bore and a land 57 to be variably positioned relative to a drain passage 58. Fluid pressure is exerted against the left-hand end of the valve by flow through a port 59 to an open-ended bore 60 within the valve. Depending upon the setting of the spring 55, the valve spool 54 establishes a predetermined pressure of fluid delivered to the port 49 leading to the inlet passages 45 and 46. A spring guide and bore end closure 61 threads into an end of the bore 50. The pressure-regulating valve is optional and is not required when a source of regulated pressure is available.

Each of the housing bores 15 and 16 has a pilot pressure passage extending therefrom to the bottom side 12 of the housing. As shown particularly in FIG. 2, a pilot pressure passage 65 extends from the bore 15 and a pilot pressure passage 66 extends from the bore 16. There are additional auxiliary pilot pressure passages 67 and 68 extending from the housing bores which are normally capped, as shown by caps 69 and 70, but which are usable in initial adjustment of the structure in a manner to be described.

A passage 75 in the housing 10 communicates with the chamber 11 for electrical leads which extend to the linear motor 20.

When assembled with an underlying housing engaging in gasketed relation with the bottom side 12 of the housing 10, the parts are held in assembled relation by a number of interconnecting fastening members, as indicated at 76.

Figure 1:
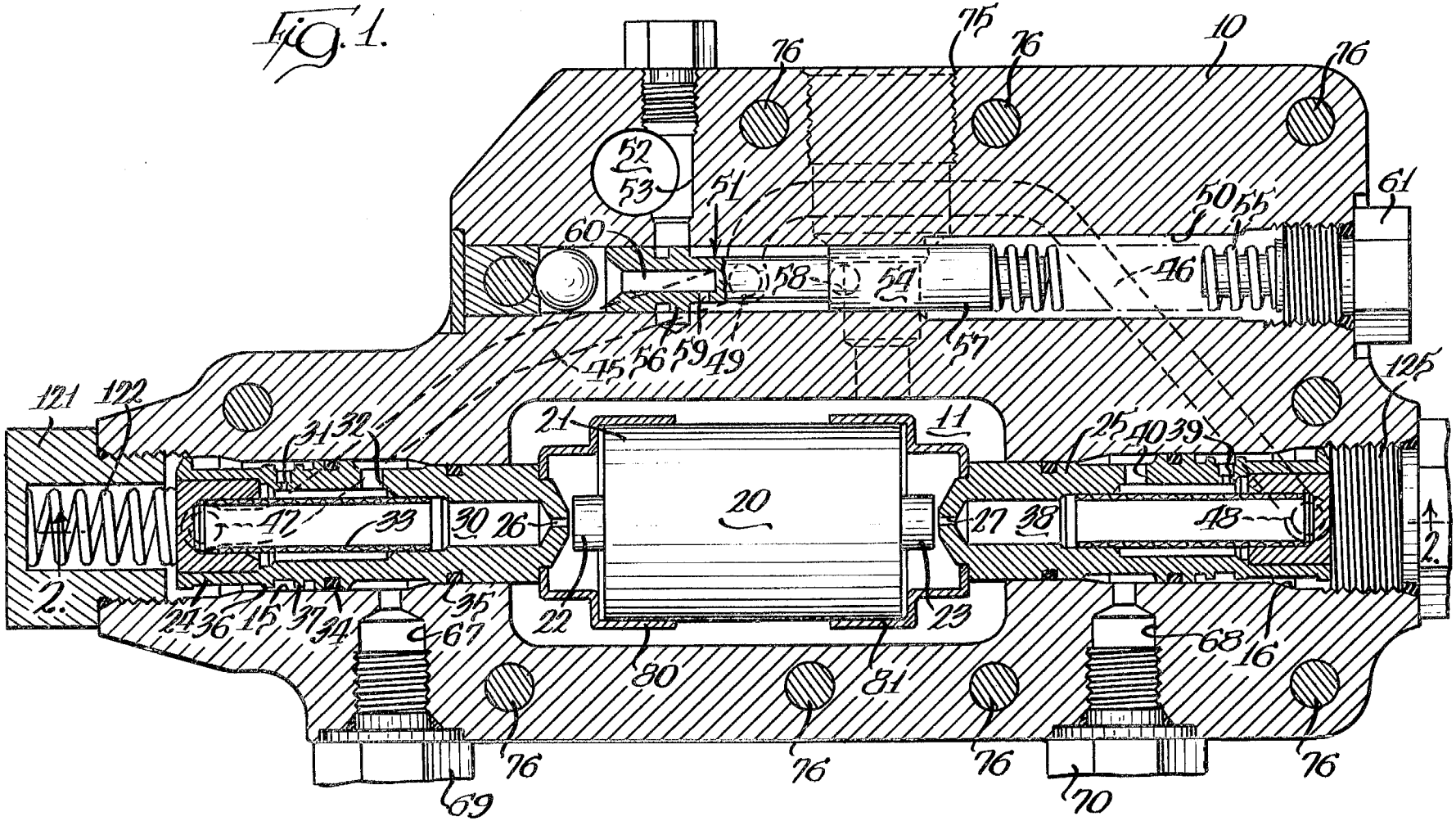
FIG. 1 is a central plan section of the electro-hydraulic control structure.

The primary purpose of the electro-hydraulic control structure is to establish a differential pilot pressure by differing pressures at the pilot pressure ports 65 and 66 or to establish a pilot pressure at one of the ports if the device to be controlled does not rely upon a pressure difference between the two pilot pressures at the two pilot ports. In accomplishing this, a regulated inlet pressure is delivered through the inlet passages 45 and 46 to the two housing bores 15 and 16 with the fluid flowing to the interior of the nozzles and the orifices 31 and 39 restricting said flow. The pilot pressure at each of the pilot ports 65 and 66 is determined by the pressure existing within the nozzle internal bores. This pressure is controlled by flow through the nozzle ports as determined by the spacing between an end of the armature and a nozzle port. As shown in FIG. 1, with the armature in a centered position, the ends 22 and 23 thereof are equidistant from the nozzle ports 26 and 27 so that the flow out of the nozzles is equal and, therefore, there are equal pressures within the internal bores of the nozzles and which is the pressure at the pilot pressure passages 65 and 66 because of the communication through ports 32 and 40 therewith. When the linear motor is operated to shift the armature to have the end 23 move closer to the nozzle port 27 with resultant reduced flow therethrough there is an increased pressure within the nozzle 25. At the other nozzle 24, the armature 22 is moved away from the nozzle port 26 to permit increased flow to drain, with resultant reduction in the pressure within the nozzle 24. This results in a differential pressure at the pilot ports 65 and 66 which can be used for control, such as the first stage of a multiple-stage control or as a direct control of an operating device. As known in the art, the armature can move various distances and the distance which the armature moves can be controlled by a circuit including a manually positioned rheostat. Thus, a range of differential pressures is possible.

An accurate maintainable relation between the linear motor 20 and the nozzles 24 and 25 is required for reliable, repeatable operation. This is accomplished by motor-nozzle coupling means, shown in FIGS. 1 and 2. This means comprises a cup-shaped coupler associated one with each end of the motor and with each of the nozzles. A first of the couplers is indicated at 80 and coacts with the left-hand end of the motor 20 as viewed in FIG. 1 and with the nozzle 24, while a second coupler 81 coacts with the opposite end of the motor and the nozzle 25. The couplers are deformable and are shown in one of their operative shapes in FIG. 1 while, in FIG. 2, they are shown in their shape after initial assembly and prior to adjustment. Referring to the pre-adjusted coupler shown in FIG. 1, the couplers are of the same structure and that of coupler 80 is particularly described. An end wall is provided with a central opening 85 to receive an end of the nozzle 24 therein with the remainder of the end wall forming an outwardly inclined deformable rim 86 surrounding the nozzle port. The coupler has an annular peripheral wall 87 which is of two different diameters to provide a shoulder 88 which abuts against an end of the motor casing 21. Comparing the initial assembly view of FIG. 2 with the adjusted structure shown in FIG. 1, it will be noted that the deformable rims 86 of the couplers have been shifted from an outward inclination to positions generally normal to the peripheral wall of the coupler.

With the parts assembled as shown in FIG. 2, the adjustment is then made by use of a tool shown in association with the structure in FIG. 2. This tool includes a block 100 with a central opening 101. The block pivotally mounts a pair of members 102 and 103 on pivot members 104 and 105, respectively, which span the central opening and extend into the block. These members are actuable toward each other by means of the rotatable members 110 and 111 threaded into the block and which coact with the pivoted members 102 and 103, respectively. Each of the pivoted members 102 and 103 has an upwardly open concave recess at the upper end thereof with a pair of spaced-apart fingers 115 and 116. In the adjustment operation, the caps 69 and 70 are removed and gauge connections made thereto and inlet 52 is connected to a source of pressure fluid. The pivoted member 103 of the tool is moved into position to have the forked upper end thereof engage the shoulder of the coupler 81, while the pivoted member 102 of the tool is backed-off to have the forked upper end thereof at a distance from the shoulder of the adjacent coupler. The threaded member 111 is then operated to advance pivoted member 103 which shifts the linear motor 20 and the nozzle 24 to a limit position in the nozzle bore 15 as determined by an end land 120 of the nozzle moving to a limit position against an end member 121 threaded in the housing bore 15 and in the process compressing a spring 122 seated in a bore within the end member 121 and engaging an end of the nozzle. With the nozzle seated, further actuation of the pivot member 103 causes deformation of the deformable rim 86 of the coupler 87 until a desired pressure reading is obtained in the pilot pressure port 65 which is indicative of the proper adjustment between the nozzle and the motor to have the proper spacing between the nozzle port 26 and the end 22 of the armature, with the armature being centered during this operation.

The pivoted member 103 is then backed-off to a remote position and the pivoted member 102 is pivoted by actuation of the threaded member 110 to engage against the shoulder 88 of the coupler 80 which causes advance of the motor 20 toward the right as viewed in FIG. 2 with the nozzle 25 bottoming against a threaded insert 125 in the housing bore 16 and with further movement causing deformation of the deformable rim of the coupler 81 until a desired pilot pressure is indicated. The pivoted member 102 is then backed-off and the tool is removed from association with the bottom side 12 of the housing 10. After removal of the tool, the nozzles and motor are normally in a neutral position, shown in FIG. 1, as caused by the spring 122 urging the components to a position toward the right with the nozzle 25 abutting the end closure 125.

After this adjustment, the ports 67 and 68 are recapped and the housing 10 is associated with an underlying housing structure having passages to communicate with the pilot ports 65 and 66 for delivery of the pilot pressures to a desired location of use and which also closes off the recesses defining the inlet passages 45 and 46.

Each of the couplers 80 and 81 has at least one opening in the peripheral wall thereof whereby oil flowing through a nozzle port may reach a drain connection communicating with the chamber 11. As shown, the coupler 80 has such an opening 130 and the coupler 81 has the opening 131.

From the foregoing, it will be seen that the couples which are shaped and formed of a material, such as mild steel, enabling deformation thereof by use of the described tool can be initially assembled and, thereafter, adjusted to obtain a predetermined fixed distance relation between the nozzle ports and the ends of the motor armature. After initial adjustment, the structure is sealed against access by the bottom side 12 of the housing 10 being engagement with another member and held in fixed relation thereto by the attaching members 76 and with there being no apparent means for adjustment of the relation between the motor and the nozzles which avoids inadvertent improper adjustment of the electrohydraulic control structure.

With the foregoing structure, the spacing of the nozzles and the motor can be made insensitive to movement relative to the main housing, such as might happen with shock, vibration or differential thermal expansion and with no locking device required for the adjustment means. Initial adjustment of the spacing establishes a certain flow from the nozzles which, therefore, establishes a pressure drop from inlet pressure to the nozzle bores. An electrical input signal to the linear motor causes a shift of the armature and correspondingly increases the distance at one nozzle and decreases the distance at the other. Where the distance is less, the flow of oil out of the nozzle is less and the pilot pressure within that nozzle becomes larger. Correspondingly, where the distance increases, the flow out of the nozzle increases and the output pilot pressure of the associated nozzle becomes less.

I claim:

1. A motor-nozzle coupling means for a motor with a casing and having a member movable relative to a nozzle port of a nozzle for controlling the flow of fluid through the nozzle port characterized by a coupler engaging said motor casing and nozzle to establish the spacing therebetween and said coupler being shaped and of a material enabling permanent deformation after assembly with the motor housing and nozzle to set the desired permanent spacing therebetween.

2. A structure as defined in claim 1 wherein said coupler is generally cup-shaped with an end wall having a central opening to receive a port of the nozzle and with the remainder of the end wall defining a deformable rim and a peripheral wall of the coupler having a stepped section to provide a shoulder engageable with the motor casing.

3. A structure as defined in claim 1 including a pair of said nozzles at opposite ends of said motor which has the movable member extendable from both ends thereof, and a pair of said couplers associated with said motor and one with each of said nozzles.

4. A structure as defined in claim 3 including a housing having a chamber for said motor and a pair of bores for movably mounting said nozzles, and means for deforming said couplers after the nozzles are in said bores and the motor is in said chamber.

5. An electro-hydraulic control structure having a housing with a chamber and a pair of aligned bores at opposite sides of the chamber, a pair of nozzles movably mounted in said bores with each nozzle having a nozzle port opening toward said chamber, a linear electric motor movably positioned in said chamber and having an armature extendable from opposite ends of the motor and operable to a position to control the rate of fluid flow through the nozzle ports, and a pair of couplers extending from opposite ends of the motor and engageable one with each of said nozzles to maintain a fixed distance between said motor and said nozzles.

6. A structure as defined in claim 5 wherein said couplers are deformable after assembly with the motor and nozzles to set said fixed distance.

7. A structure as defined in claim 6 wherein the couplers are generally cup-shaped with a rim which is deformable under force applied during adjustment after assembly.

8. A structure as defined in claim 7 wherein the cup-shaped couplers have a shoulder intermediate the ends thereof whereby one of the shoulders is engageable by a tool to exert force on said motor and cause deformation of the rim of the other coupler until the desired fixed distance between the motor and the nozzle associated with the last-mentioned coupler is obtained.

9. A structure as defined in claim 8 wherein the coupler has an end wall with an opening to receive an end of the nozzle and the remainder of the end wall defines the deformable rim which initially is inclined toward the nozzle and which can be deformed to a lesser inclination.

10. A structure as defined in claim 9 wherein said nozzles and motor are free for limited movement in the housing to enable deformation of both couplers successively to set the desired distances.

11. An electro-hydraulic control structure having a housing with a chamber communicable with a drain passage and a pair of aligned bores at opposite sides of the chamber, passages in said housing including a pair of fluid pressure inlet passages leading one to each of said bores and a pair of pilot pressure passages extending one from each of said bores, a pair of nozzles movably mounted in said bores and each having an internal bore communicating with an inlet pressure passage through an orifice and a pilot pressure passage and having a nozzle port at an end thereof opening toward said chamber for flow from said internal bore to the chamber, and a linear electric motor movably positioned in said chamber and having an armature extendable from opposite ends of the motor and operable to a position to control the rate of fluid flow through the nozzle ports into the chamber and thus establish a certain fluid pressure within the internal bores of the nozzles, a pair of deformable couplers extending from opposite ends of the motor and engageable one with each of said nozzles to maintain a pre-set fixed minimum distance between said motor and said nozzles, means at the end of one nozzle bore limiting movement of the nozzle therein in one direction, and means within the other nozzle bore acting on the nozzle therein urging both nozzles and said motor toward said movement-limiting means at the end of said one bore.

12. An electro-hydraulic control structure having a housing with a chamber and a bore at one side of the chamber, a nozzle movably mounted in said bore and having a nozzle port opening toward said chamber, a linear electric motor movably positioned in said chamber and having an armature extendable from an end of the motor and operable to a position to control the rate of fluid flow through the nozzle port, and a coupler in non-contacting relation with the housing and extending from an end of the motor and engageable with said nozzle to maintain a fixed distance between said motor and said nozzle.

13. A structure as defined in claim 12 wherein said coupler is permanently deformable after assembly with the motor and nozzle to set said fixed distance.

14. A structure as defined in claim 13 wherein the coupler is generally cup-shaped with a rim which is deformable under force applied during adjustment after assembly.

* * * * *